US005546918A

United States Patent [19]

Mayer et al.

[11] Patent Number: 5,546,918

[45] Date of Patent: Aug. 20, 1996

[54] METHOD OF ADJUSTING THE COMPOSITION OF THE OPERATING MIXTURE FOR AN INTERNAL COMBUSTION ENGINE

[75] Inventors: Ulrich Mayer, Waiblingen; Ernst Wild, Oberriexingen; Peter Kaltenbrunn, Bietigheim-Bissingen, all of Germany

[73] Assignee: Robert Bosch GmbH, Stuttgart, Germany

[21] Appl. No.: 472,644

[22] Filed: Jun. 7, 1995

[30] Foreign Application Priority Data

Jul. 2, 1994 [DE] Germany ..... 44 23 241.1

[51] Int. Cl.[6] ..... F02D 41/14

[52] U.S. Cl. ..... 123/674

[58] Field of Search ..... 123/674, 675, 123/681, 685, 686, 687, 689, 695

[56] References Cited

U.S. PATENT DOCUMENTS 4,545,355 10/1985 Takao et al. ..... 123/674
4,584,982 4/1986 Clement et al. ..... 123/687
4,827,937 5/1989 Kohler et al. ..... 123/674
4,844,041 7/1989 Ave et al. ..... 123/674
5,158,062 10/1992 Chen ..... 123/674
5,251,437 10/1993 Furuya ..... 123/674
5,406,927 4/1995 Kato et al. ..... 123/674

*Primary Examiner*—Willis R. Wolfe
*Attorney, Agent, or Firm*—Walter Ottesen

[57] ABSTRACT

The invention relates to a learning control method for adjusting the composition of an operating mixture for an internal combustion engine. The method includes the steps of: detecting the actual value of the composition; forming a control variable as a function of the instantaneous deviation of the actual value from the desired value; logically coupling the control variable to a base value of an adjusting parameter of the composition and driving an actuator on the basis of the logically coupled value; and, learning of an additional intervention in the control loop from the performance of the control loop wherein the learning takes place at a speed which is at least dependent upon temperature.

7 Claims, 3 Drawing Sheets

METHOD OF ADJUSTING THE COMPOSITION OF THE OPERATING MIXTURE FOR AN INTERNAL COMBUSTION ENGINE

FIELD OF THE INVENTION

The invention relates to a learning control method for adjusting the composition of the operating mixture for an internal combustion engine.

BACKGROUND OF THE INVENTION

To adjust the above composition, it is conventional to determine basic values for a fuel quantity as a function of the air quantity drawn in and the speed of the internal combustion engine and to correct these values by means of a superposed control.

Since the control system performs subsequent injections on the basis of prior measurements of an exhaust-gas sensor, delay times occur, for example, because of the transit time of the mixture between injection and measurement by the sensor.

When reaching a new operating point with basic values which are not optimal, a temporary incorrect adaptation of the mixture composition and therefore increased exhaust emissions occur. Basic values for a particular type of internal combustion engine, which have once been determined and stored, can lead to incorrect adaptations, for example, because of scatter between individual samples caused by the manufacturing process or because of drift phenomena caused by deterioration.

Continuous adaptation of the precontrol to these drift phenomena by means of a learning control method makes it possible to comply with exhaust regulations throughout the life of the internal combustion engine.

An example of a learning control method is known from U.S. Pat. No. 4,584,982.

When operating internal combustion engines with learning control methods, problems may occur in certain circumstances which do not occur in this way in internal combustion engines without learning control methods. It has been found that the correction based on the adaptation can initially reach values which appear implausibly high when the internal combustion engine is operated over short distances. In combination with the detection of a fault based on an implausible adaptation value, this can lead to an unnecessary fault signal. Since the implausibly high values act in the direction of mixture leaning, it is moreover impossible to rule out difficulties in subsequent starts because of excessive leaning of the mixture.

SUMMARY OF THE INVENTION

The object of the invention is to provide an adaptation method which avoids the disadvantages mentioned without restricting the other desired properties of adaptation.

This object is achieved by the learning control method of the invention which provides for a temperature-dependent variation of the speed of learning. This teaching is based on the realization that the problems stated above are linked with the proportion of fuel in the lubricating oil for the internal combustion engine. With a cold start, fuel gets into the engine oil and evaporates during the operation of the internal combustion engine as the temperature increases. Evaporated fuel is fed for combustion via the crankcase venting system.

The resulting, unwanted enrichment of the mixture, which can be up to 30% at idle, is corrected by the lambda control. The learning mixture adaptation stores this correction as a long-term effect and leans the mixture to counteract the enrichment. If this leaning is relatively pronounced and no fuel evaporates from the oil when the engine is next started, the starting problems mentioned at the outset can occur. The invention avoids these problems in that the speed of learning of the mixture adaptation is slowed down significantly when evaporation of fuel from the engine oil is expected.

The entry of fuel into the engine oil is a transient phenomenon for which the mixture does not have to be corrected on a permanent basis. The invention avoids this unwanted correction without restricting the adaptive compensation of long-term drifts in the precontrol mixture.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
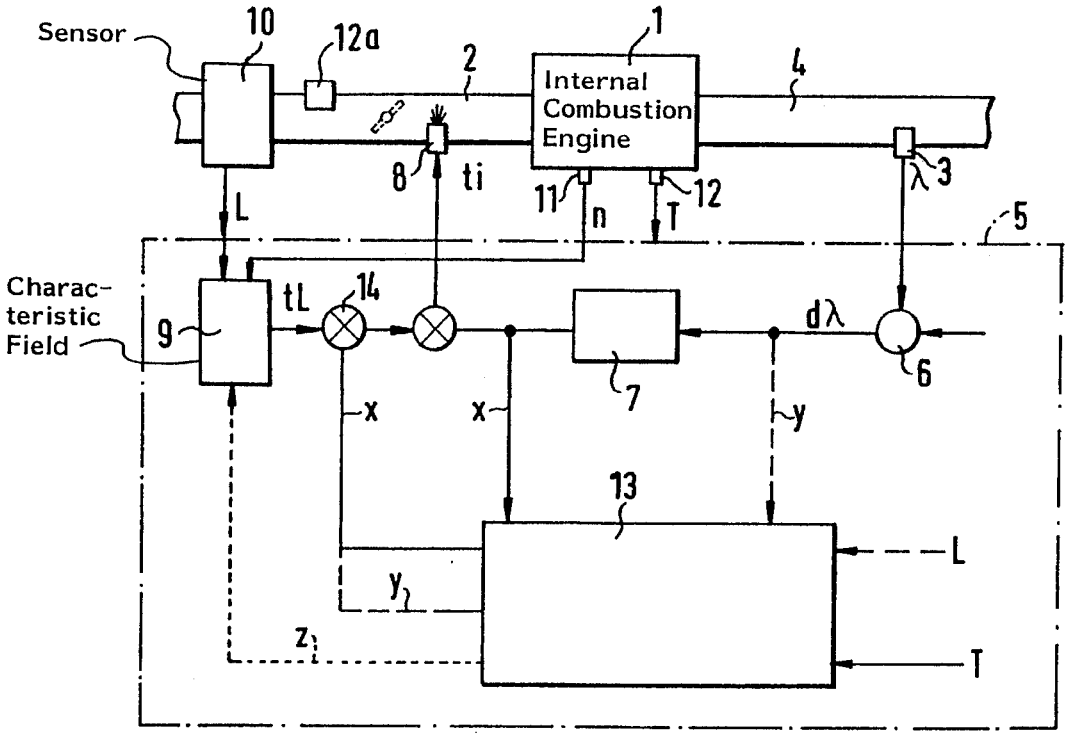
FIG. 1 shows a control loop for adjusting the composition of the operating mixture for an internal combustion engine.

Reference numeral 1 in FIG. 1 identifies an internal combustion engine, which is supplied with an operating mixture from an intake pipe 2. The actual value of the mixture composition is detected by an exhaust-gas sensor 3 in the exhaust-gas pipe 4 of the internal combustion engine and is compared in a control unit 5 to a predetermined desired value. The instantaneous control deviation as the result of comparison 6 leads to an actuating variable FR by applying a control algorithm 7. This variable FR, when combined with a basic value tp, determines, for example, the injection time pulse with which an injection valve 8 in the intake pipe 2 is driven. The basic value can be read out of a characteristic field 9 as a function of the load L and the speed n of the internal combustion engine, which are detected by respective sensors 10 and 11. The internal combustion engine is also equipped with at least one temperature sensor 12 or 12*a*, which detects the temperature of the internal combustion engine or of a torque converter (sensor 12) interacting with the internal combustion engine, or the temperature of the intake air (sensor 12*a*). This configuration is known as is the function of block 13, which represents a means or an algorithm for adapting the control loop to changing conditions, for example, to deterioration-related drifts in the output signal of the load sensor. For this purpose, block 13 processes a signal decoupled from the control loop, for example the control deviation or the control variable FR, in such a way that not only the instantaneous value but also the previous history of this value are taken into account. The previous history can be determined, for example, by averaging. If the control variable FR is, for example, multiplicatively combined with well-adapted basic values, then FR will, as a time average, be equal to 1. If, however, the basic values considered per se lead to an incorrect adaptation in the lean direction, FR will, as a time average, be greater than 1. In order to bring FR to the value 1, which is neutral with respect to its combination with the basic values, an additional intervention 14 in the formation of the injection time pulse is performed, which has the effect to bring the control variable FR back to the value 1. In the shown example, an additional multiplication by the averaged value achieves the required effect. This case is represented by the line marked by x in FIG. 1. As an alternative to the variable FR dependent on the control deviation, it is also possible to use the control deviation directly as an input variable for the learning correction. This case is identified by the dashed lines marked by y. The dotted line z indicates that the adaptive intervention can also be performed on the characteristic field itself.

Figure 2:
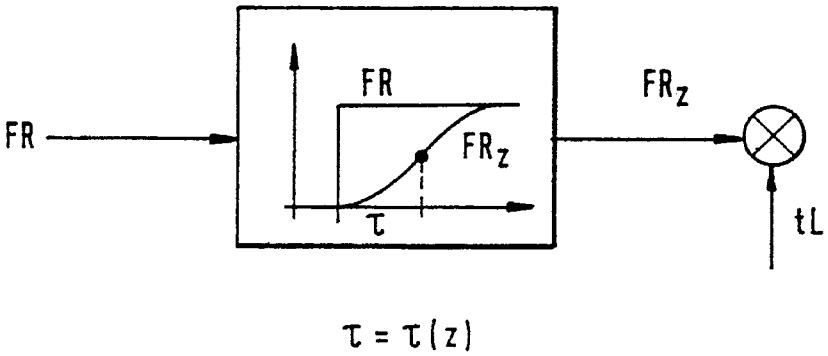
FIG. 2 shows a schematic relating to a first adaptation method.
Figure 3:
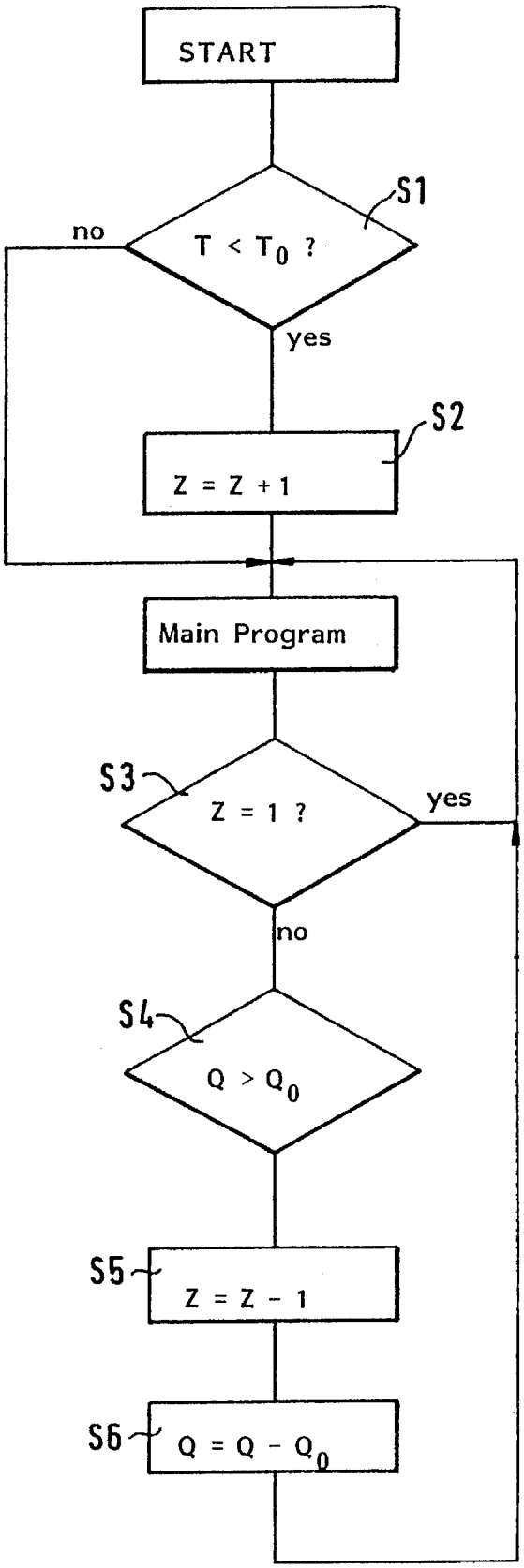
FIG. 3 shows a flowchart as an example of a possible sequence of steps for the method according to the invention; and, FIG. 4 shows a schematic relating to a further adaptation method in which the invention can be utilized.

FIG. 2 shows one possibility of how the speed of learning can be influenced. The starting point here is a global on-line adaptation in which the additional adaptive correction is changed during operation and detects all the basic values from the characteristic field globally. In this arrangement, block 13 contains a low pass 14 having a time constant $\tau$. The value FRz smoothed by means of this low pass represents the additional adaptive intervention. In this context, a large time constant is equivalent to slow adaptation and a small time constant is equivalent to rapid adaptation. In one embodiment of the invention, the value of the time constant is coupled to a count Z of the counter, with the result that the speed of the adaptation or learning is varied as a function of the count. This counter is used to simulate the entry of fuel into the engine oil. A flowchart for this embodiment is shown in FIG. 3. The counter is incremented when a start is carried out below a temperature threshold $t_0$ (step $S_1$, step $S_2$). This can be the temperature of the engine and/or intake air or the transmission-oil temperature.

The counter is decremented once it has been ensured that the oil temperature has been above a threshold for a sufficiently long time. It can then be assumed that the fuel has evaporated again. The air-mass flow Q summed by integration during travel can, for example, be used as a measure for a high oil temperature. When this variable exceeds a threshold $Q_0$, the counter is decremented. Here, 0 must not be undershot. This function is ensured by the sequence of steps $S_3$ to $S_6$ which lead successively to a Z value of 1 and therefore to a normal speed of learning during the continuous operation of the internal combustion engine. It is also possible as an alternative to reduce Z continuously to a standard value.

the invention can be utilized not only in the specific example of an adaptation described above but can be used in all mixture adaptation methods.

Figure 4:
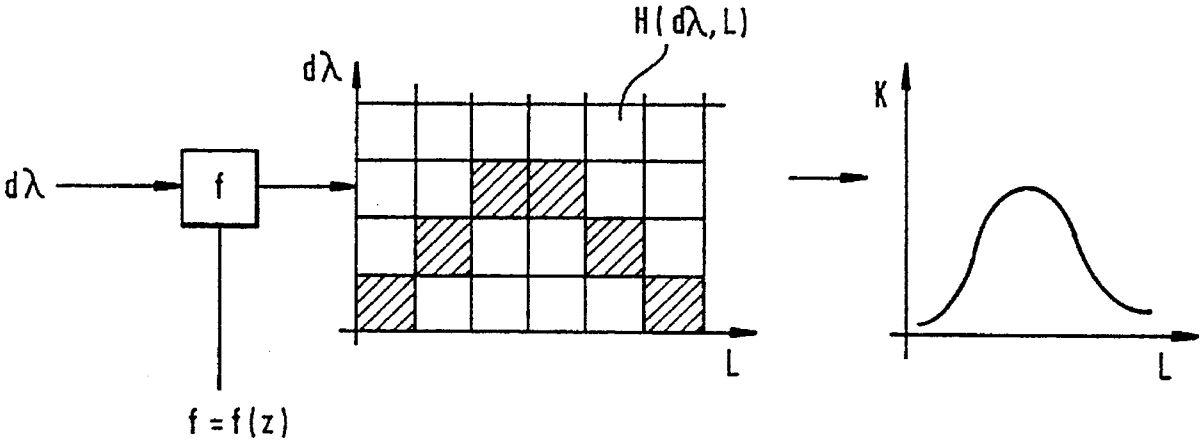

FIG. 4 shows an example of a structural off-line adaptation. In this type of adaptation, the system registers during a first operating phase of the internal combustion engine what kind of control deviations $d\lambda$ occur in certain load conditions L. For this purpose, a count $H(d\lambda,L)$ is, for example, increased when the associated combination $d\lambda$ (L),L occurs during the operation of the internal combustion engine. The hatched areas in the characteristic field in FIG. 4 symbolize high counts and therefore a large control deviation in the mid range of load. To remedy this situation, a correction characteristic K(L) is determined off-line and used as an additional intervention in the next operating phase of the internal combustion engine.

In this type of adaptation, the clock frequency f with which counts $H(d\lambda,L)$ are changed, can be varied as a function of the count Z. A suitable relationship for this purpose would be $f \sim (1/Z)$, for example, since this dependence provides a slower adaptation (f) in the event of a rising count Z.

It is understood that the foregoing description is that of the preferred embodiments of the invention and that various changes and modifications may be made thereto without departing from the spirit and scope of the invention as defined in the appended claims.

What is claimed is:

1. A learning control method for adjusting a composition of an operating mixture in a control loop of an internal combustion engine, the method comprising the steps of:

detecting an actual value of the composition;

providing a desired value of the composition;

forming a control variable as a function of the instantaneous deviation of the actual value from the desired value;

logically coupling the control variable to a base value of an adjusting parameter of said composition and driving an actuator on the basis of the logically coupled value; and, learning of an additional intervention in the control loop from a performance of the control loop wherein the learning takes place at a speed which is at least dependent upon temperature.

2. The method of claim 1, wherein said speed of said learning is reduced when, at the start of the engine, at least one of the following temperatures is below a pregiven first temperature threshold: engine coolant temperature, engine lubricant temperature, intake-air temperature and transmission lubricant temperature.

3. The method of claim 1, wherein said engine generates heat during operation and said speed of said learning is increased when a quantity representing said heat exceeds a predetermined threshold value, said heat being generated by the engine since the start thereof.

4. The method of claim 3, wherein said speed of said learning is increased successively to a predetermined value as a function of said heat generated by the engine since the start thereof.

5. The method of claim 3, wherein the amount of fuel consumed since a start or the integral of a load signal computed since the start of the engine functions as a quantity representative of said heat generated by the engine since the start thereof.

6. The method of claim 4, wherein one of the following variables is measured: engine coolant temperature, engine lubricant temperature, intake-air temperature and transmission lubricant temperature; and, a time duration elapsed since exceeding at least a pregiven second temperature threshold for said one variable functions as a quantity representative of the amount of said heat generated since the start of the engine.

7. The method of claim 3, wherein said speed of said learning is increased continuously to a predetermined value as a function of said heat generated by the engine since the start thereof.

* * * * *